US005370194A

United States Patent [19]

Anderson

[11] Patent Number: 5,370,194

[45] Date of Patent: Dec. 6, 1994

[54] DRIVE HEAD ASSEMBLY FOR DRILLING MACHINE

[75] Inventor: Llewellan Anderson, Renton, Wash.

[73] Assignee: The Robbins Company, Kent, Wash.

[21] Appl. No.: 49,121

[22] Filed: Apr. 19, 1993

[51] Int. Cl.[5] ..... E21B 3/02

[52] U.S. Cl. ..... 173/216; 173/152; 173/197; 173/213

[58] Field of Search ..... 173/197, 152, 213, 216, 173/164; 175/162

[56] References Cited

U.S. PATENT DOCUMENTS

| | | | |
|---|---|---|---|
| 2,049,268 | 7/1936 | Ludwick . | |
| 3,383,946 | 5/1968 | Justman . | |
| 3,454,114 | 7/1969 | Poage | 173/197 |
| 3,741,318 | 6/1973 | Klein et al. | 173/152 |
| 3,800,887 | 4/1974 | West | 173/197 |
| 3,840,272 | 10/1974 | Crane et al. . | |
| 3,965,995 | 6/1976 | Sugden . | |
| 3,999,616 | 12/1976 | Crane et al. . | |
| 4,009,909 | 3/1977 | Robbins et al. . | |
| 4,270,618 | 6/1981 | Owens . | |
| 4,646,853 | 3/1987 | Sugden et al. . | |
| 4,815,546 | 3/1989 | Haney et al. | 173/213 |
| 5,012,878 | 5/1991 | Anderson | 173/213 |
| 5,119,515 | 4/1993 | Sinclair et al. . | |

FOREIGN PATENT DOCUMENTS

| | | | |
|---|---|---|---|
| 2263428 | 7/1973 | Germany | 173/197 |
| 628306 | 10/1978 | Russian Federation . | |

*Primary Examiner*—Scott A. Smith

*Attorney, Agent, or Firm*—Graybeal Jackson Haley & Johnson

[57] ABSTRACT

The drive head assembly for a drilling machine includes a drive head body having a cavity with an upper portion and a lower portion. A bolt is located in the upper portion of the drive head body cavity, and a collet is located in the lower portion of the drive head body cavity. The collet also includes a cavity. A collet insert is located in the collet cavity, and the collet insert has a drill string opening to fixedly secure a drill string.

21 Claims, 3 Drawing Sheets

DRIVE HEAD ASSEMBLY FOR DRILLING MACHINE

BACKGROUND OF THE INVENTION

1. Field of the Invention

The invention relates to earth drilling machines. More specifically, the present invention pertains to a drive head assembly for a drilling machine, and more specifically to a drive head assembly having a float box housing and removable float box housing insert.

2. Description of the Prior Art

U.S. Pat. No. 5,012,878 issued to Anderson discloses a drive head apparatus for driving the drill string of a rock boring machine. The apparatus comprises one or two drill string connectors having resilient means such as a coil spring acting therebetween, with floating bearings separably secured thereto, and with each bearing arrangement comprising respective cooperating, axially fixed bearing seating surfaces. Each floating bearing is in the form of a softer metal insert replaceable on the associated connector without replacement of the drill string connector. A spline cylindrical drive insert rotatably drives the drill string connector and is separable from the drive body in which it is seated and is axially reversible to swap wear ends, or is readily replaceable without need for replacement of the entire drive body.

U.S. Pat. No. 3,800,887 issued to West discloses a drive head assembly for an earth drilling machine having an output shaft which projects downwardly through an opening in the support frame. A crown gear at the lower end of the shaft mates with a complementary crown gear at the upper end of a drive head main body situated below the frame. A large bolt extends upwardly through an opening in an upper wall of the drive head main body. The bolt includes a large diameter head which seats against an inner surface of the upper wall of the drive head main body and a threaded stem portion which threads into a lower end portion of the shaft. A drive box is located inside of the drive head main body and is coupled thereto by means of splines in a manner permitting it to both float axially and swivel sideways.

Both of these prior art patents disclose drive head assemblies, and drilling machines employing drive head assemblies, wherein the drive head assemblies include a collet, or float box housing, which is unitary in construction. Thus, these unitary collets include splines which mate with complimentary splines on the drive head proper, a rounded shoulder which pivots and swivels within the drive head proper, and an interior portion that threadedly engages the drill string. This type of unitary collet must be replaced when one portion of it is excessively worn. Excessive wear usually first occurs at the point of threaded connection between the collet and the drill string, with the collet splines and collet shoulder still having useful life remaining at the time of collet replacement. Additionally, because high strength alloys are required for threaded connection of the collet and the drill string, the entire unitary collet must be comprised of these expensive materials.

A need thus exists for a drive head assembly of a drilling machine that has a collet of composite construction comprised of a collet member having splines and a pivotable shoulder, and a separable collet insert for threaded connection with the drill string, said collet insert being replaceable when worn without the replacement of the collet member.

SUMMARY OF THE INVENTION

A drive head assembly for a drilling machine includes a drive head body having a cavity, and a collet in the drive head body cavity. The collet also includes a cavity. A collet insert is located in the collet cavity, and the collet insert has a drill string opening to fixedly secure a drill string. According to this invention the collet insert is removably attached to the collet for convenient replacement of the collet insert without the need for replacing the separate collet.

Preferably, the drive head assembly also includes splines on the exterior of the collet which couple to splines on the interior of the drive head body for joint rotation of the collet and drive head body with relative pivotal movement of the collet relative to the drive head body. The drive head body also preferably includes a bolt located in the upper portion of the drive head body cavity, and the collet insert is removably attached to the collet by an insert retaining ring that is biased against the collet insert by a spring that contacts the insert retaining ring and the bolt. Seals are preferably located between the collet and the bolt, as well as between the collet insert and the collet.

BRIEF DESCRIPTION OF THE DRAWINGS

These and other features of the present invention will be evident when considered in light of the following specification and drawings in which.

DESCRIPTION OF THE PREFERRED EMBODIMENT

Figure 1:
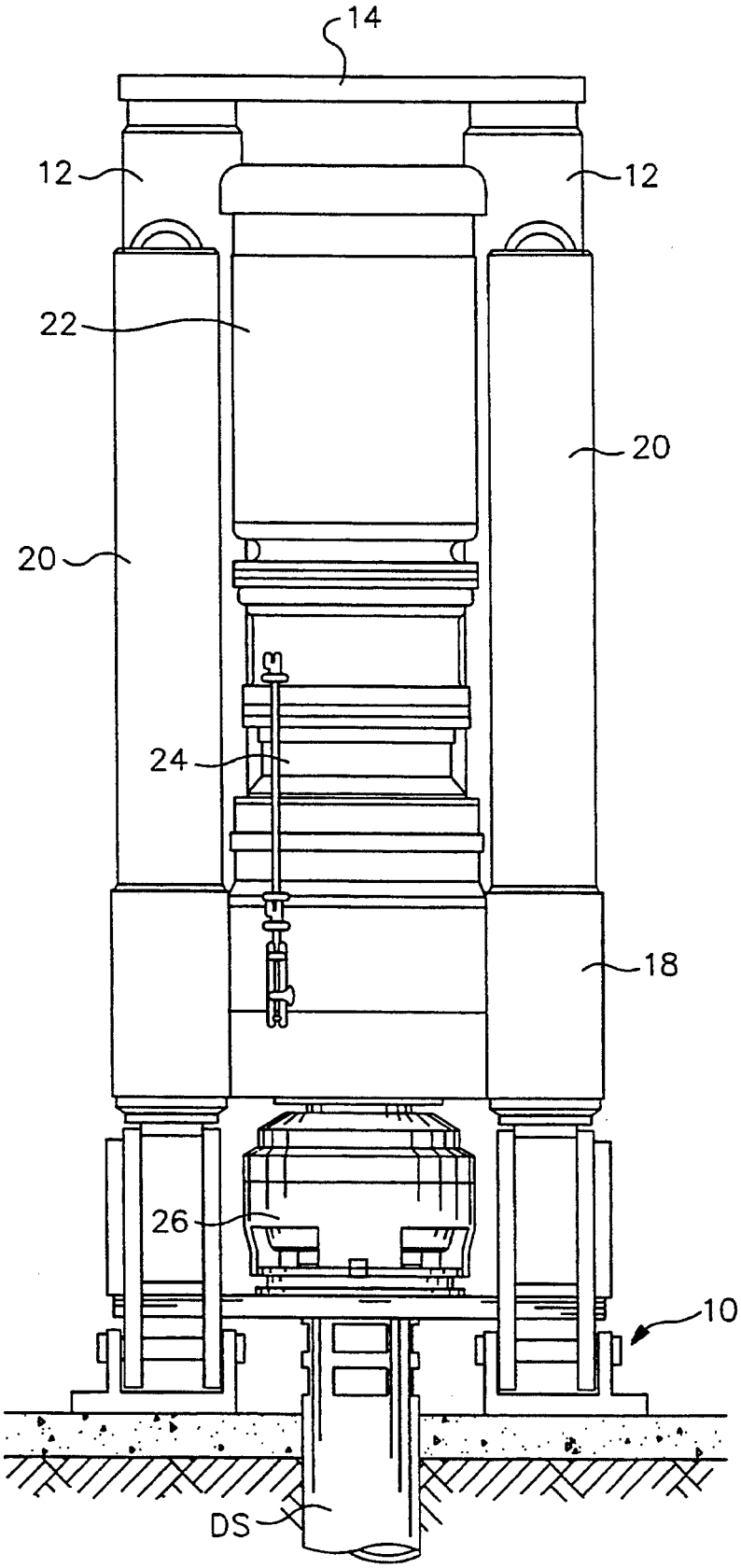
FIG. 1 is a front elevational view of a traveling drive head type drilling machine typically embodying the present invention.

Referring to FIG. 1, the drilling machine is shown to comprise a base assembly 10 which is secureable to the ground at the drilling site. The plurality of guide columns 12 extend vertically upwardly from the base assembly 10 and are connected together at their upper ends by means of a head frame 14. A traveling support frame 18 is provided which includes guide sleeve means (not shown) surroundingly engaging the guide columns 12, and serving to guide the frame 18 along the columns 12. One or more linear hydraulic motors 20 are interconnected between the traveling frame 18 and the base assembly 10, and are used for moving the frame 18 rectilinearly upwardly and downwardly along the guide columns 12.

The traveling frame 18 carries the rotary drilling equipment, comprising a drive motor 22, a gear box 24 and a rotary drive head 26. During use, the traveling support frame 18 and the drilling equipment 22, 24, and 26 carried thereby are forceably moved upwardly and downwardly by the motors 20 while, at the same time, the drive head 26 is rotated and it, in turn, transmits rotative torque to a connected drill string.

Figure 2:
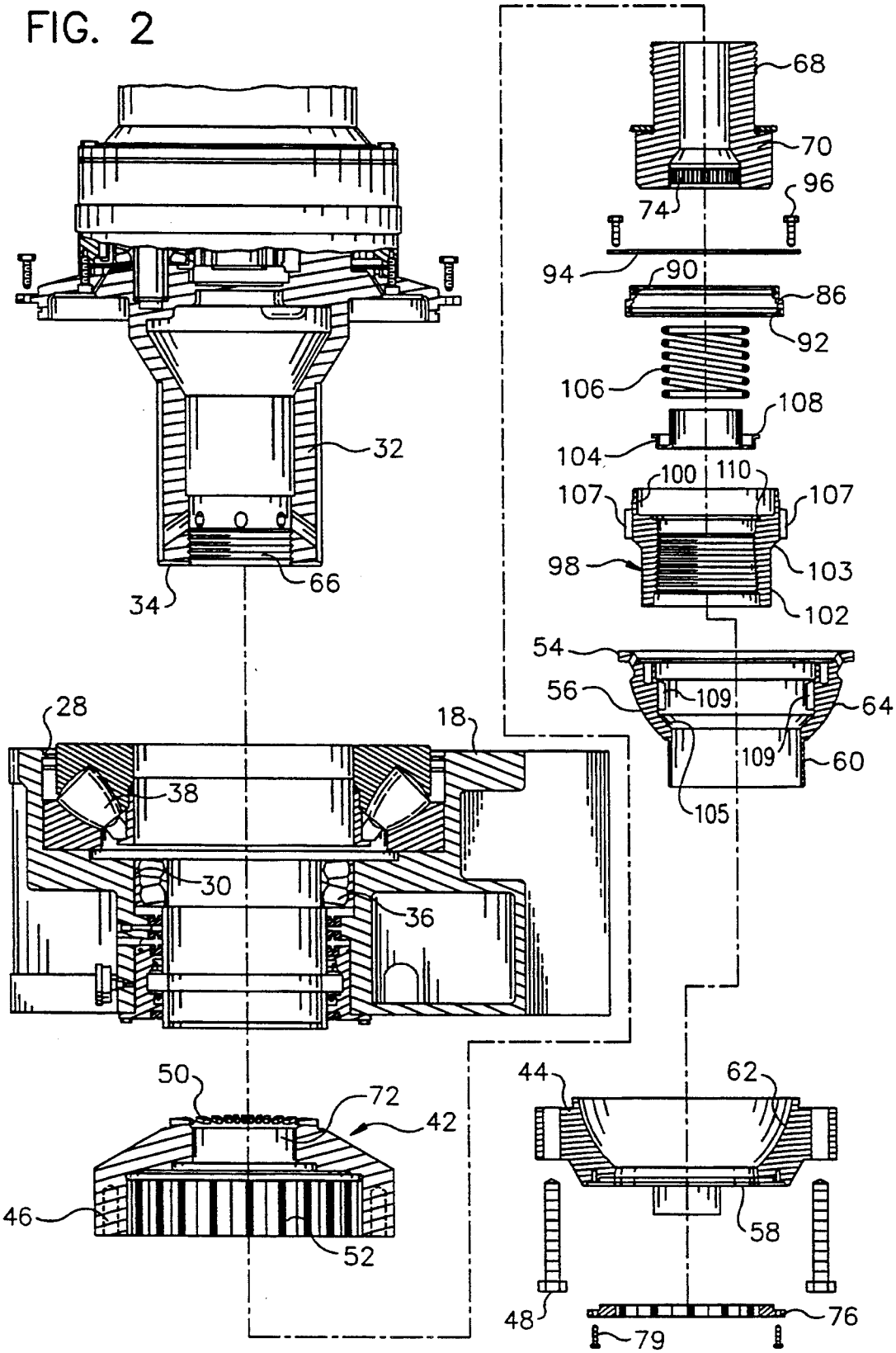
FIG. 2 is an enlarged exploded sectional view of the drive head and fragmentary portions of the traveling support frame and the drive box carried thereby.

Referring to FIG. 2, the traveling support frame 18 is shown to have a hollow three-dimensional body which, in the preferred embodiment, is of one piece integral construction. It includes an upwardly directed main bearing receiving recess 28, below which there is a second, smaller diameter, second bearing recess 30. The gear box 24 includes a tubular output shaft 32 having a set of crown gear teeth 34 at its lower end. A relatively small diameter radial anti-friction bearing 36 is received within the bearing cavity 30 and a larger diameter combination anti-friction bearing 38 is received within the bearing recess 28. A first diameter portion of the shaft 32 extends through the bearing 36 and is rotatively coupled to the inner race thereof. A larger diameter upper portion 40 of the input shaft is received within the inner race of the larger bearing 38 and is rotatably coupled thereto. The outer race of the bearings 36 and 38 are fixed relative to the frame 18.

Figure 3:
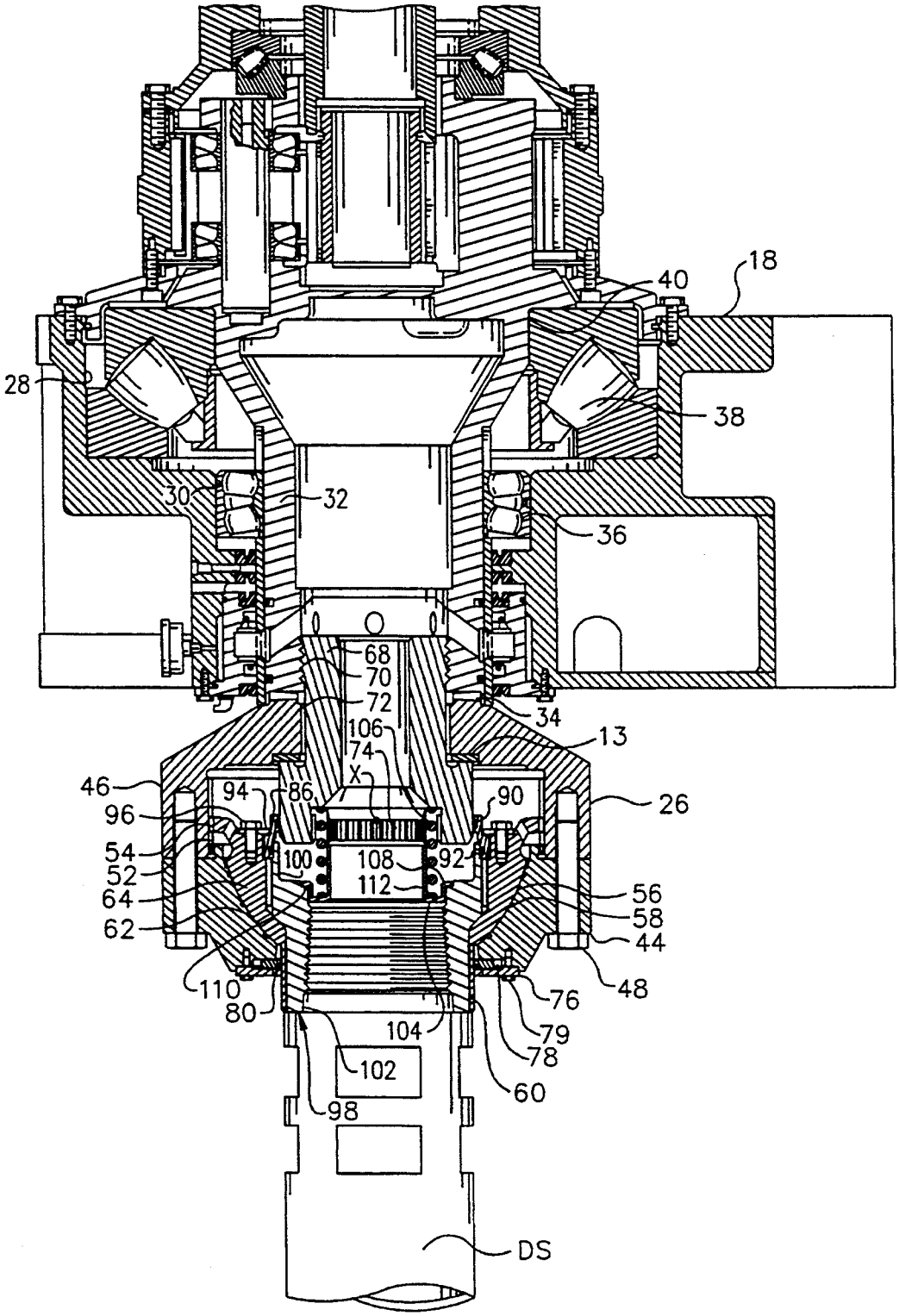
FIG. 3 is a sectional view of the exploded sectional view of FIG. 2.

Referring more specifically now to FIGS. 2 and 3, the drive head 26 includes a generally bell-shaped outer or main body 42 which is of composite construction. It is composed of a lower portion 44 and an upper portion 46 connected together by means of a circular array of bolts 48. The upper end of the upper portion 46 includes a set of crown gear teeth 50 which compliment the crown gear teeth 34 of the lower end of input shaft 32.

The inner wall of drive head upper portion 46 includes a plurality of axial splines 52 for receiving in a mating fashion the shorter external splines 54 provided around the outer periphery of collet member or float box housing 56. The collet member 56 fits into the inner cavity of the drive head upper portion 46, the splines 54 meshing with the splines 52. The drive head lower portion 44 includes a central opening 58 sized to loosely receive the small diameter lower end portion 60 of collet member 56. Drive head lower portion 4 also includes an annular wall portion 62 bordering the opening 58 and serving as a retainer for the spherical shaped upper portion 64 of collet member 56. More specifically annular wall portion 62 of drive head lower portion 44 and the external surface of upper portion 64 of collet member 56 form a tapered interface between drive head lower portion 44 and collet member 56 which accommodates for thrust forces during drilling.

The mating of the relatively short collet splines 54 with the longer drive head splines 52 is done with sufficient clearance, both radially and circumferentially so that collet member 56 can swivel or tilt about point X in nearly any direction for a full 360° around drive head 26. In the direction of tilt, a tooth of splines 54 on one side of the head swings downwardly and a tooth of splines 54 on the opposite side swings upwardly. At right angles to the direction of tilt, a pair of diametrically opposite teeth of splines 54 must turn sideways an amount equal to the tilt angle. Sufficient clearance is provided in the mesh to permit these movements. This "swiveling" or "tilting" arrangement prevents bending movements from being transferred from the drill pipe into the gear box or to the bearings 36 and 38. Such avoidance of bending at the drive head also reduces fatigue stress in the drill pipe, substantially increasing the life of the total drill string.

The splines 52 and 54 permit a limited amount of vertical "floating" of collet member 56. This "floating" capability is utilized during drill stem makeup and breakout to accommodate for thread travel without axial movement of the drive head proper. It is also utilized advantageously to permit easy movement of the brake out wrench into an out from engagement with a collar type wrench member installed on the drill pipe.

The gear box output shaft 32 is internally threaded, and these threads receive the externally threaded upper end portion 68 of a relatively large hollow bolt 70 which serves to secure the drive head upper portion 46 to the input shaft 32.

During assembly, the shaft 32 is inserted vertically downwardly through the two bearings 36 and 38, carried by the traveling cross frame 18. The drive head upper portion 46 is then brought into position below the frame 18 and the crown gear teeth 50 thereon are set into engagement with the crown gear teeth 34 on shaft 32. Next, the bolt 70 is inserted upwardly through the opening 72 in member 46 and is tightly threaded into the lower end portion of input shaft 32. A wrench socket 74 is formed in the lower head end of bolt 70. The end of a key or insert type wrench is inserted into the socket 74 and is used for rotating the bolt 70. Next, the floating collet member 56 is inserted in place along with the below-described collet insert or float box insert. Then, the lower head member 44 is installed and secured to the head member 46 by means of bolts 48.

The drive head 26 includes a retainer 76 shown as a separate member adapted to be secured to the drive head lower portion 44 by means of a plurality of bolts 79. A seal cavity 78 is formed in the lower end portion of member 44. An annular ring type seal member 80 sized to contact the smaller diameter lower end portion 60 of collet member 56 is set into recess 78.

An annular retainer ring 86 is inserted downwardly into the upper end portion of collet member 56. This retainer ring 86 includes an annular seal portion 90 which snugly receives the cylindrical side wall portion of the bolt 70, and slides therealong during axial and tilting movement of collet member 56. Annular retaining ring 86 is secured to collet member 56 by means of retainer 94 and cap screw 96. Collet insert or float box insert 98 contacts second annular seal portion 92 of annular retaining ring 86, as well as collet member 56. Collet insert 98 is a substantially tubular member with a broadened upper portion 100 having splines 107, a narrowed lower portion 102, and a contoured portion 103 therebetween. Contoured portion 103 of collet insert 98 seats in taper 105 of lower end portion 60 of collet member 56 to form a tapered interface between collet insert 98 and collet member 98 which accommodates for thrust forces during drilling.

Splines 107 of collet insert 98 mesh tightly with splines 109 of collet member 56, thus insuring torque transmittal from collet member 56, through collet insert 98 and to drill string DS. The fit between splines 107 and splines 109 is slightly interference to insure that collet member 56 and collet insert 98 behave as a unit during operation. Retainer ring 104 is biased against collet insert 98 by spring 106. More specifically, lip 108 of insert retainer ring 104 fits in seat 110 of collet insert 98 and spring 106 is biased between the lower end of bolt 70 and base 112 of ring 104 to insure that collet insert 98 engages the threads of drill string DS during upward or horizontal drilling. The above configuration thus overcomes the effects of gravity. Thus, ring 104 and spring 106 assist floating of collet 56 and collet insert 98 in upward (vertical) or horizontal drilling where friction prevents floating of collet member 56. In normal down drilling, ring 104 and spring 106 are not required.

Collet insert 98 is thus the component that threadedly connects the drill string with drive head 26. Collet insert 98 can be conveniently replaced by removing insert retaining ring 104, spring 106, annular retaining ring 86, retainer 94 and cap screw 96. Collet insert 98 is then forceably removed from collet 56. It is important to note that replacement of collet insert 98 does not necessarily mandate replacement of collet member 56, which generally will have a longer useful life than collet insert 98 because splines 54 spherical shaped upper portion 64 of collet member 56 wear more slowly than does collet insert 98, which suffers considerable wear due to its repeated connection with and disconnection from the drill string. Furthermore, because higher strength alloys are only required for the portion of the component that is threadedly connected to the drill string, only collet insert 98, and not collet member 56, need be composed of these more expensive materials.

The above described embodiments are intended to be descriptive, not restrictive. The full scope of the invention is determined by the following claims, and any and all equivalents are included.

I claim:

1. A drive head assembly for a down drilling machine comprising:

a drive head body having a cavity;

a collet in said drive head body cavity, said collet having a cavity, an integral external bearing surface, and an interior surface; and a removable collet insert in said collet cavity, said collet insert having a drill string opening to fixedly secure a drill string, said removable collet insert having an exterior surface that is substantially entirely supported by said interior surface of said collet, said removable collet insert being substantially entirely received within said collet to isolate said collet insert from said drive head body.

2. The drive head assembly of claim 1, further comprising:

spline means coupling said drive head body and said collet for joint rotation with relative pivotal movement of said collet with respect to said drive head body.

3. The drive head assembly of claim 1, further comprising a bolt means in said drive head body cavity.

4. The drive head assembly of claim 3, further comprising seal means between said collet and said bolt means and between said collet insert and said collet.

5. The drive head assembly of claim 1, further comprising:

a retainer adjacent said collet insert; and spring means biased between said retainer and said drive head body.

6. The drive head assembly of claim 1, wherein said collet is a tubular member having a broadened upper portion and a narrowed lower portion angled with respect to said upper portion to form a seat, said collet insert is a tubular member contoured to fit said seat of said collet, and said collet and said collet insert have meshing splines.

7. A drive head assembly for a down drilling machine comprising:

a drive head body having a cavity with a lower portion;

a collet in said lower portion of said drive head body cavity, said collet having a cavity, an integral external bearing surface, and an interior surface;

a retainer adjacent said collet;

spring means biased between said retainer and said drive head body; and a removable collet insert in said collet cavity, said collet insert having a drill string opening to fixedly secure a drill string, said removable collet insert having an exterior surface that is substantially entirely supported by said interior surface of said collet, said removable collet insert being substantially entirely received within said collet to isolate said collet insert from said drive head body.

8. The drive head assembly of claim 7, further comprising:

spline means coupling said drive head body and said collet for joint rotation with relative pivotal movement of said collet with respect to said drive head body.

9. The drive head assembly of claim 7, further comprising seal means between said collet insert and said collet.

10. The drive head assembly of claim 7, wherein said collet is a tubular member having a broadened upper portion and a narrowed lower portion angled with respect to said upper portion to form a seat, said collet insert is a tubular member contoured to fit said seat of said collet, and said collet and said collet insert having meshing splines.

11. A drive head assembly for a down drilling machine, comprising:

a drive head body having a cavity with an upper portion and a lower portion;

bolt means in said upper portion of said drive head body cavity;

a collet in said lower portion of said drive head body cavity, said collet having a cavity, an integral external bearing surface, and an interior surface;

spline means coupling said drive head body and said collet for joint rotation with relative pivotal movement of said collet with respect to said drive head body; and a collet insert in said collet cavity, said collet insert having a drill string opening to fixedly secure a drill string, said removable collet insert having an exterior surface that is substantially entirely supported by said interior surface of said collet, said removable collet insert being substantially entirely received within said collet to isolate said collet insert from said drive head body;

seal means between said collet and said bolt means and between said collet insert and said collet;

spline means between said collet and said collet insert;

a retainer adjacent said collet insert; and spring means biased between said retainer and said drive head body.

12. A collet insert assembly for a down drilling drive head assembly including a drive head body having a cavity and a collet in the drive head body cavity, the collet having a cavity, an integral external bearing surface and an interior surface, said collet insert assembly comprising:

a removable collet insert in the collet cavity, said collet insert having a drill string opening to fixedly secure a drill string, said removable collet insert having an exterior surface that is substantially entirely supported by the interior surface of the collet, said removable collet insert being substantially entirely received within said collet to isolate said collet insert from said drive head body.

13. The collet insert assembly of claim 12 further comprising:

a retainer adjacent said collet insert; and spring means biased between said retainer and the drive head body.

14. The collet insert assembly of claim 12, wherein the drive head assembly also includes a bolt in the drive head body cavity, said collet insert assembly further comprising seal means between said collet and the bolt and between said collet insert and said collet.

15. The collet insert assembly of claim 12, wherein the collet of the drive head body is a tubular member having a broadened upper portion and a narrowed lower portion angled with respect to the broadened upper portion to form a seat, said collet insert of said collet insert assembly is a tubular member contoured to fit the seat of the collet, and said collet and said collet insert having meshing splines.

16. Down drilling apparatus comprising:

a drive head assembly comprising a drive head body having a cavity, a collet in said drive head body cavity, said collet having a cavity, an integral external bearing surface, and an interior surface and a removable collet insert in said collet cavity, said collet insert having a drill string opening to fixedly secure a drill string, said removable collet insert having an exterior surface that is substantially entirely supported by said interior surface of said collet, said removable collet insert being substantially entirely received within said collet;

a rotary output shaft attached to said drive head assembly; and a traveling support frame mounted for rectilinear movement along a drill hole line, said traveling support frame carrying said drive head assembly and said rotary output shaft.

17. The drilling apparatus of claim 16, wherein said drive head assembly further comprises:

spline means coupling said drive head body and said collet for joint rotation with relative axial movement of said drive head body and said collet.

18. The drilling apparatus of claim 16, wherein said drive head assembly further comprises a bolt means in said drive head body cavity.

19. The drilling apparatus of claim 18, wherein said drive head assembly further comprises seal means between said collet and said bolt means and between said collet insert and said collet.

20. The drilling apparatus of claim 16 further comprising:

a retainer adjacent said collet insert; and spring means biased between said retainer and said drive head body.

21. The drilling apparatus of claim 16, wherein said collet of said drive head assembly is a tubular member with a broadened upper portion and a narrowed lower portion angled with respect to said broadened upper portion to form a seat, said collet insert is a tubular member contoured to fit said seat of said collet, and said collet and said collet insert have meshing splines.

* * * * *